US012114827B2

(12) United States Patent
Aras et al.

(10) Patent No.: US 12,114,827 B2
(45) Date of Patent: Oct. 15, 2024

(54) DISHWASHER

(71) Applicant: BSH Hausgeräte GmbH, Munich (DE)

(72) Inventors: Sedat Aras, Tekirdağ (TR); Hasan Dereli, Istanbul (TR); Serkan Eren, Tekirdağ (TR); Emre Güntav, Istanbul (TR); Caner Kara, Munich (DE); Kasim Yazan, Istanbul (TR)

(73) Assignee: BSH Hausgeräte GmbH, Munich (DE)

( * ) Notice: Subject to any disclaimer, the term of this patent is extended or adjusted under 35 U.S.C. 154(b) by 241 days.

(21) Appl. No.: 17/762,754

(22) PCT Filed: Oct. 20, 2020

(86) PCT No.: PCT/EP2020/079463
§ 371 (c)(1),
(2) Date: Mar. 23, 2022

(87) PCT Pub. No.: WO2021/078718
PCT Pub. Date: Apr. 29, 2021

(65) Prior Publication Data

US 2022/0354338 A1 Nov. 10, 2022

(30) Foreign Application Priority Data

Oct. 25, 2019 (TR) ..... 2019/16591
Jun. 30, 2020 (TR) ..... 2019/10271

(51) Int. Cl.
*A47L 15/00* (2006.01)
*A47L 15/22* (2006.01)
(Continued)

(52) U.S. Cl.
CPC ..... *A47L 15/50* (2013.01); *A47L 15/0049* (2013.01); *A47L 15/22* (2013.01); *A47L 15/23* (2013.01);
(Continued)

(58) Field of Classification Search
None
See application file for complete search history.

(56) References Cited

U.S. PATENT DOCUMENTS

2010/0147339 A1 6/2010 Bertsch
2014/0305475 A1 10/2014 Cetinkaya

FOREIGN PATENT DOCUMENTS

DE 1291869 B 4/1969
DE 3732451 A1 4/1989
DE 4018048 A1 12/1991

OTHER PUBLICATIONS

National Search Report TR 2020/10271 dated May 12, 2021.
National Search Report TR 201916591 dated Jul. 30, 2021.
Intenational Search Report TR 201916591 dated Jan. 14, 2021.

*Primary Examiner* — Levon J Shahinian
(74) *Attorney, Agent, or Firm* — Michael E. Tschupp; Andre Pallapies; Brandon G. Braun

(57) ABSTRACT

The present invention relates to a dishwasher, especially a domestic dishwasher, comprising a body, a washing chamber provided in the body wherein the washing is realized, at least one rack which is located in the washing chamber for loading dishes to be washed and at least one spray arm which rotates around itself and provides water into the washing chamber for washing the dishes. The dishwasher, especially the domestic dishwasher, comprises furthermore a checking mechanism which is configured to translate the sliding movement of the at least one rack into rotation of the at least one spray arm.

19 Claims, 8 Drawing Sheets

(51) Int. Cl.
*A47L 15/23* (2006.01)
*A47L 15/42* (2006.01)
*A47L 15/50* (2006.01)

(52) U.S. Cl.
CPC ..... *A47L 15/42* (2013.01); *A47L 15/501* (2013.01); *A47L 15/507* (2013.01); *A47L 2401/24* (2013.01)

DISHWASHER

CROSS-REFERENCES TO RELATED APPLICATIONS

This application is the U.S. National Stage of International Application No. PCT/2020/079463, filed Oct. 20, 2020, which designated the United States and has been published as International Publication No. WO 2021/078718 A1 and which claims the priorities of Turkish Patent Applications, Serial No. 2019/16591, filed Oct. 25, 2019, and Serial No. 2020/10271, filed Jun. 30, 2020, pursuant to 35 U.S.C. 119(a)-(d).

The contents of International Application No. PCT/2020/079463 and Turkish Patent Applications, Serial No. 2019/16591 and 2020/10271 are incorporated herein by reference in their entireties as if fully set forth herein.

BACKGROUND OF THE INVENTION

The present invention relates to a dishwasher, especially a domestic dishwasher, comprising a body, a washing chamber provided in the body wherein the washing is realized, at least one rack which is located in the washing chamber for loading dishes to be washed and at least one spray arm which rotates around itself and provides water into the washing chamber for washing the dishes.

A dishwasher, especially a domestic dishwasher, is designed to wash dirty dishes and dirty cutlery. The dishes are placed on the at least one rack and the water is supplied to the dirty dishes and the dirty cutlery through the nozzles of at least one spray arm. By the rotation of the at least one spray arm the dirty dishes receive water and are washed thereof. Proper rotation of the at least one spray arm is very important in the washing process of the dishes. To check the turnability of the at least one spray arm before starting the washing process, the user must try to turn the at least one spray arm by hand respectively manually. That requires extra effort from the user.

If not checked, the spray arm may stuck because of the wrong placement of the dishes and not turn during the washing process. The user may not notice the fact that the spray arm is not turning. The lack of rotation of the spray arm may cause unwashed dishes, which require a second washing process. This leads to unnecessary use of water and electricity.

The document WO 2013/064394 A1 discloses a dishwasher comprising a washing tub having a base, a rear wall and two side walls surrounding the base, a door providing access to the washing tub from its lower side and opening by tilting forward, a rack wherein the objects to be washed are placed, providing it to move forwards/backwards, having a washing position whereat it is placed on the base to entirely remain inside the washing tub, a loading position whereat it is positioned on the inner surface of the door by being moved forwards when the door is open and whereat loading-unloading can be performed and a spray arm extending from the base towards inside the washing tub, remaining under the rack when the rack is in the washing position, spraying water towards inside the rack by rotating around itself.

The invention provides an additional improvement, an additional advantage or an alternative to the prior art.

BRIEF SUMMARY OF THE INVENTION

The purpose of the present invention is to provide dishwasher, especially a domestic dishwasher, with an improved checking mechanism for the rotation of the spray arm.

The invention, to achieve the above-mentioned purpose, is a dishwasher, especially a domestic dishwasher, comprising a body, a washing chamber provided in the body wherein the washing is realized, at least one rack which is located in the washing chamber for loading dishes to be washed and at least one spray arm which rotates around itself and provides water into the washing chamber for washing the dishes. The dishwasher, especially the domestic dishwasher, comprises a checking mechanism which is configured to translate the sliding movement of the at least one rack into rotation of the at least one spray arm.

When the sliding movement of the at least one rack is performed, the checking mechanism checks the proper rotation of the spray arm by translating the sliding movement of the at least one rack into rotation of the spray arm. Thus, the user is aware of the fact that the spray arm properly rotates and the washing process of the dirty dishes will be carried out without any concerns. If the user notices that at least one complete turn of the spray arm cannot be realized, then the user can understand that dishes are not loaded in a proper way and that the user must organize the dishes again.

A dishwasher, especially a domestic dishwasher, comprises usually at least two racks (i.e. lower rack and upper rack), sometimes also three racks (i.e. lower rack, upper rack and third rack). The lower rack is positioned below the upper rack. In a possible embodiment of the invention, the rack is the lower rack. Thus, the user can load more dishes to the dishwasher, especially the domestic dishwasher, and sort the dishes with more options.

In a first possible embodiment of the invention, the checking mechanism comprises at least one gear and at least one preferably gear rack or linear gear. Thus, the at least one gear rack or linear gear engages to the gear and turns the spray arm that is coupled to the at least one gear. The user can easily notice the rotation of the spray arm without having to check it manually.

In a further possible embodiment of the invention, the at least one gear rack is located on the lower rack. Thus, the at least one gear rack slides while it is connected to the lower rack for translating the sliding movement into rotation of the lower spray arm.

The gear rack is preferably a linear gear rack. Thus, the engagement of the lower rack and the gear rack is realized in a proper and simple manner. The toothed side of the gear rack is facing towards the lower spray arm where it connects to base of the washing chamber and therefore to the base of the dishwasher.

The gear rack can be attached to the lower rack by means of clipping. Thus, low-cost and simple manufacture of the gear rack and ease mounting of the gear rack is realized.

In a further possible embodiment of the invention, the at least one gear is located on the lower spray arm. Thus, the engagement of the gear and the gear rack can be easily aligned without much effort.

The gear and the lower spray arm can be manufactured in one piece. Thus, an easier and more efficient production process is achieved.

In a further possible embodiment of the invention, the gear and the gear rack are positioned in such a way that they are detached during the washing process. Thus, the sliding movement of the upper rack into the washing chamber turns the spray arm; on the other hand, operational rotation of the spray arm does not move the upper rack forward and backward during the washing process.

In a further possible embodiment of the invention, the spray arm is directly mounted to the upper rack, preferably by means of clipping. Thus, easier and more feasible production is realized. Besides, it provides the opportunity to check the rotation of the spray arm to guarantee the convenient washing of the dishes on the upper rack.

In a further possible embodiment of the invention, the upper spray arm comprises at least one gear positioned in substantial center of the upper spray arm and/or the upper spray arm and the at least one gear are manufactured in one piece. Thus, convenient rotation is achieved for spraying the water more efficiently and an easier and more efficient production process is achieved.

In a further possible embodiment of the invention, the checking mechanism comprises a holder, which is attached to the upper rack by at least one support element. The holder is hung on the wires of the upper rack by at least one support element. Thus, if wanted, the user can easily disconnect the holder. This also provides an easier application of the holder.

In a further possible embodiment of the invention, the holder comprises a first rod, which is moved by the movement of a second rod. Thus, the first rod is pushed with more power. Therefore, more efficient turning of the spray arm is provided.

In a further possible embodiment of the invention, the first rod further comprises a linear gear on at least one end and/or the holder comprises a spring, configured to move the first rod. Thus, the turning of the upper spray arm is realized without any manual effort from the user and the stabilization and movement of the first rod are provided.

The gear and the linear gear, which is at the end of the first rod, can be positioned in such a way that they are detached during the washing process. Thus, any kind of collision between these parts is avoided when washing the dishes.

In a further possible embodiment of the invention, the holder comprises a second rod, which connects to the first rod by a joint. Thus, leveling between the rods is provided in order to achieve more efficient function of the checking mechanism.

In a further possible embodiment of the invention, the holder is attached to the upper rack, preferably by means of clipping. The holder is clipped on the wires of the upper rack. Thus, the user can remove the holder easily if wanted.

In a further possible embodiment of the invention, at least one end of the spray arm comprises at least one indicating element. Thus, a relatively easier and economically efficient production process of the spray arm is achieved without needing any additional material, element and a production step is provided.

In a further possible embodiment of the invention, the indicating element is attached by means of snap fitting, wherein the indicating element and the spray are preferably manufactured in one piece and/or wherein the indicating element is adhered to at least one end of the spray arm. Thus, an easier application of the indicating element is achieved.

The indicating element can be a mark on at least one end of the spray arm. Thus, a relatively easier and economically efficient production process and without need of additional material, element and a production step is provided. The indicating element is provided in such a way that it does not block or prevent proper turning of spray arm.

At least one end of the spray arm can be colored. Alternatively, both ends of the spray arm can be colored. Moreover, the ends of the spray arm can be differently colored. Thus, the user can easily notice the differently colored ends of the spray arm and that they change place, therefore the user no longer needs to check manually the rotation of the spray arm. Additionally, the user can easily realize the free movement of the spray arm by the changing position of the colored ends. This information is provided to the user to realize that the spray arm is free to turn without coming into any collision with the dishes on the upper rack.

At least one end of the spray arm can have an indicating element for differentiating the ends of the spray arm from each other. Thus, by means of two different ends, attention of the user can be easily caught and user can be informed about the proper loading of the dishes.

The indicating element which is provided on at least one end of the spray arm can also be colored. Thus, when the rotation movement of the spray arm is performed, the user can easily notice that the ends of the spray arm change position. Therefore, the rotation of the spray arm is provided in order to have a proper washing process.

The indicating elements on both ends of the spray arm can be differently colored. Thus, the user can easily notice the differently colored ends of the spray arm and that they change place, therefore the user no longer need to check the rotation of the spray arm manually.

The ends of the spray arm can be colored by means of engraving. Thus, more permanent coloring is achieved and the colored ends are not effected from the heat inside the washing chamber.

Moreover, the indicating element and the spray arm can be manufactured in one peace. The indicating element can be adhered to at least one end of the spray arm. The indicating element can be a mark on at least one end of the spray arm. Thus, a relatively easier and economically efficient production process is achieved. The indicating element is provided in such a way that it does not block or prevent proper turning of spray arm.

In this context, with the indications "front", "upper", "below", "top", "bottom" etc. the positions and orientations given for intended use and intended arrangement of the dishwasher and for a user then standing in front of the dishwasher in a closed position and viewing in the direction of the device are indicated.

'Loading position' in this context means, the position that the at least one rack is extracted at least partially out of the washing chamber for placing the dirty dishes on the at least one rack to be washed.

'Washing position' in this context means, the position that the at least one rack is retracted into the washing chamber of the dishwasher and the dishwasher is ready for washing process.

Each possible embodiment disclosed in this specification can be combined with the other possible embodiments disclosed in this specification if there is no any technical constraint.

If there is more than one specimen of a certain object, only one of these is given a reference numeral in the figures and in the description. The description of this specimen may be correspondingly transferred to the other specimens of the object.

Further advantages may become apparent from the following description of the figures. In the figures, exemplary embodiments of the invention is shown. The claims, the description and the figures contain a plurality of features in combination. The person having ordinary skill in the art will purposefully also consider the features separately and will find further expedient combinations.

BRIEF DESCRIPTION OF THE DRAWINGS

The figures, whose brief explanations are herewith provided, are solely intended for providing a better understanding of the present invention and are as such not intended to define the scope of protection or the context in which said scope is to be interpreted in the absence of the description.

DETAILED DESCRIPTION OF EXEMPLARY EMBODIMENTS OF THE PRESENT INVENTION

In this detailed description, the claimed dishwasher 1, especially the claimed domestic dishwasher, is explained with references to examples without forming any restrictive effect only in order to make the subject more understandable.

Figure 1:
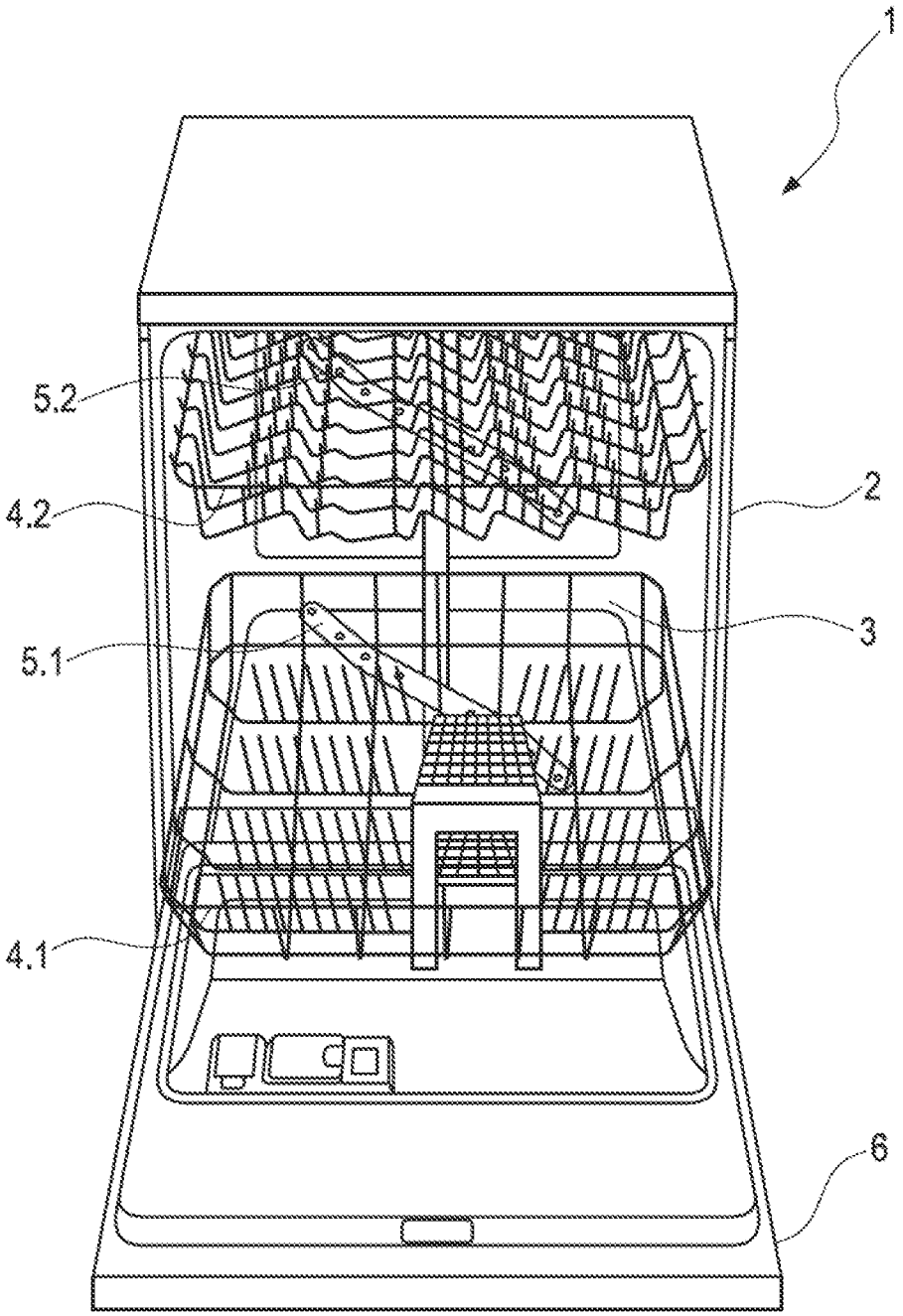
FIG. 1 shows a front view of a dishwasher nearly in its washing position.

FIG. 1 shows the dishwasher 1, especially the domestic dishwasher, nearly in its washing position. The dishwasher comprises a body 2, a washing chamber 3 provided in the body 2 wherein the washing is realized, at least one rack, presently two racks, a lower rack 4.1 and an upper rack 4.2, which are located in the washing chamber 3 for loading dishes to be washed and at least one spray arm, presently two spray arms, a lower spray arm 5.1 and an upper spray arm 5.2, which rotates around itself and provides water into the washing chamber 3 for washing the dishes, The washing chamber has at its frontside a door 6 which is shown in an position. The user pulls the racks 4.1, 4.2 to load dirty dishes and dirty cutlery to be washed. The lower rack 4.1 is extracted a short distance for loading the dirty dishes.

Figure 2:
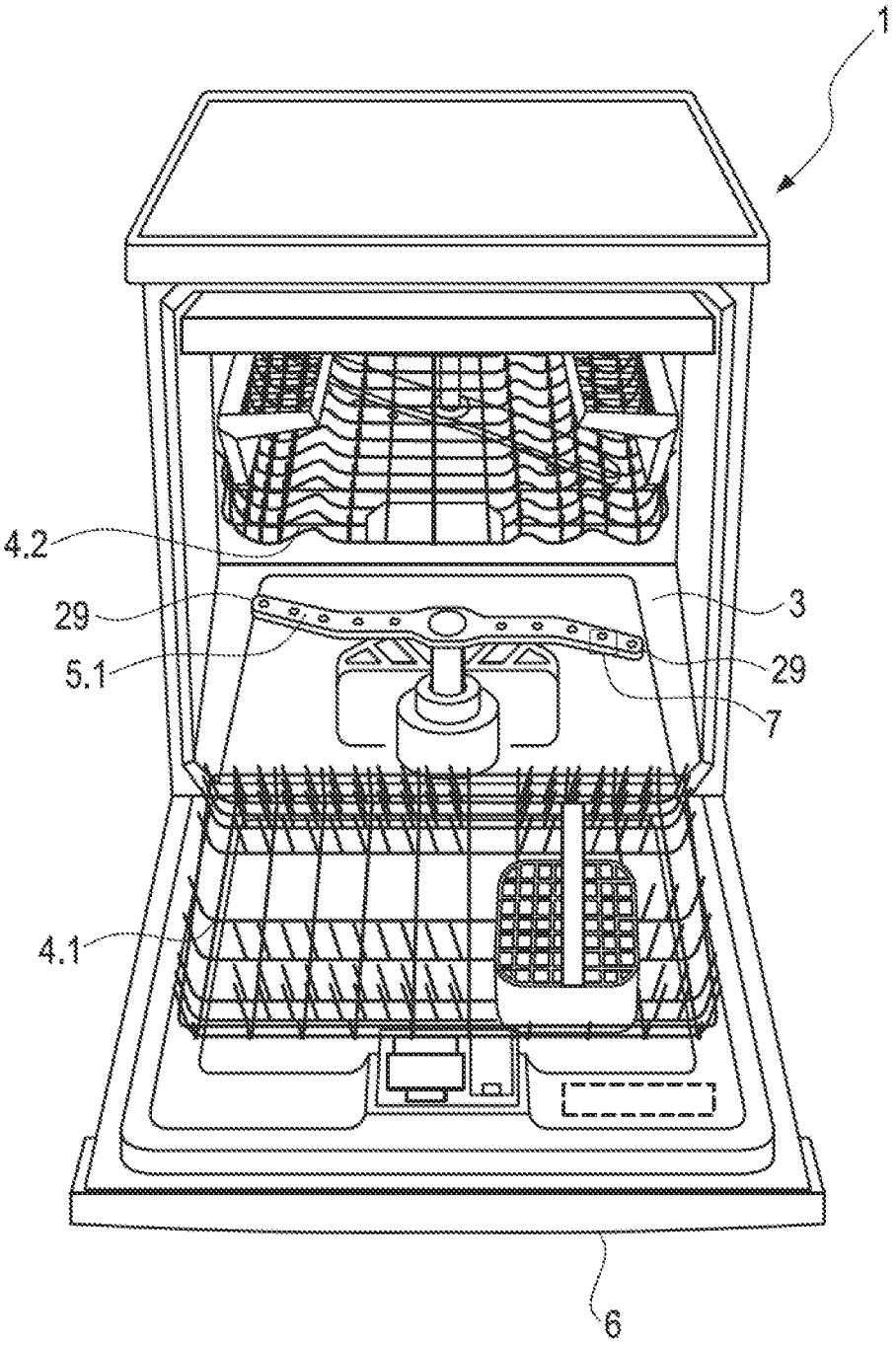
FIG. 2 shows a front view of a dishwasher in an exemplary loading position.

FIG. 2 shows the dishwasher 1, especially the domestic dishwasher, in an exemplary loading position. The lower rack 4.1 is pulled out of the washing chamber 3 and rests on the door 6 of the dishwasher 1, whereas the upper rack 4.2 is slid into the washing chamber 3.

FIG. 2 also shows that one end 29 of the lower spray arm 5.1 has an indicating element 7. Such indicating element 7 informs the user about the rotation of the lower spray arm 5.1. If the indicating element 7 changes position after the user has moved the lower rack 4.1 into the washing chamber 3 into its washing position, then the user can tell that the lower spray arm 4.1 is free to turn without any blockages and that proper movement of the lower spray arm 4.1 will be provided during the washing process of the dishes and the cutlery.

Figure 3:
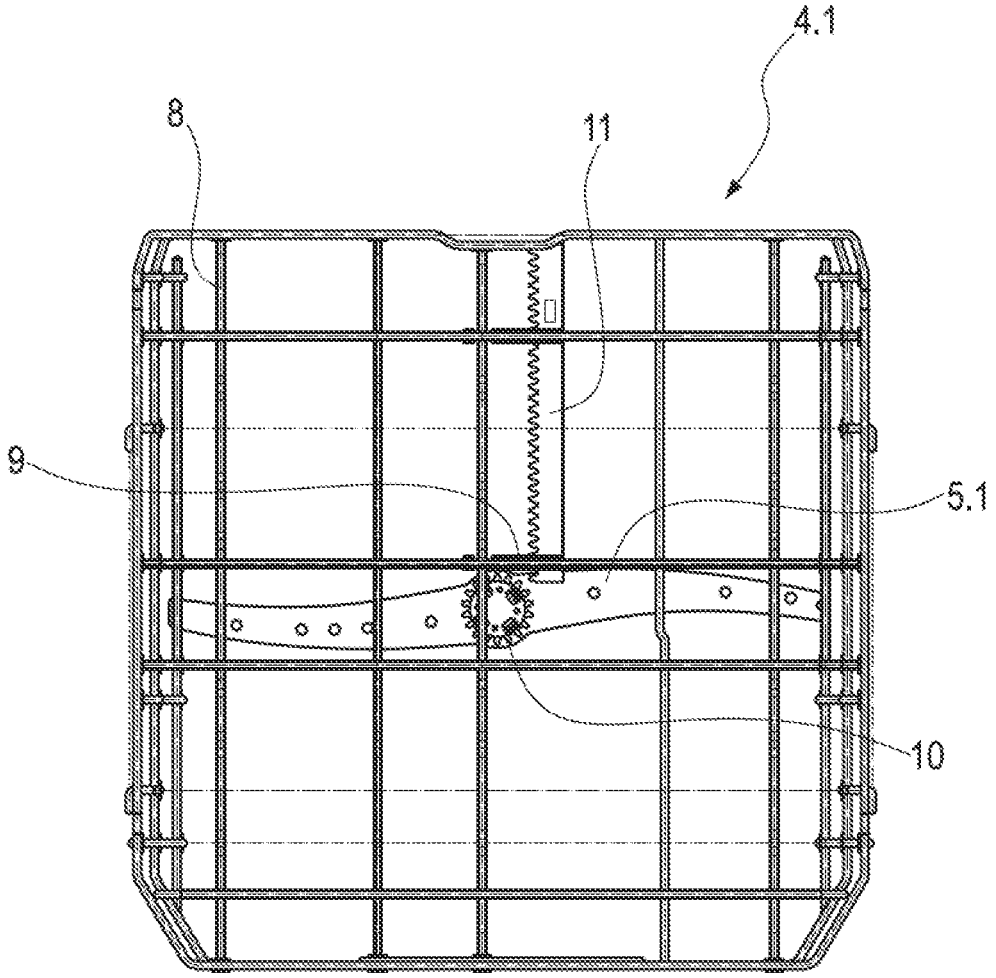
FIG. 3 shows a bottom view of the lower rack including the checking mechanism, according to a first embodiment of the present invention.

FIG. 3 shows that the lower rack 4.1, and also the upper rack 4.2 (not shown; see FIGS. 1 and 2), is constituted by multiple wires 8 crossing each other. The lower rack 4.1 has a checking mechanism 9. The checking mechanism 9 comprises a gear 10 and a gear rack 11. The gear rack 11 is hung on the wires 8 of the lower rack 4.1, preferably by means of clipping or snap fitting. The gear 10 is manufactured preferably in one piece (arrow) with the lower spray arm 4.1.

Figure 4:
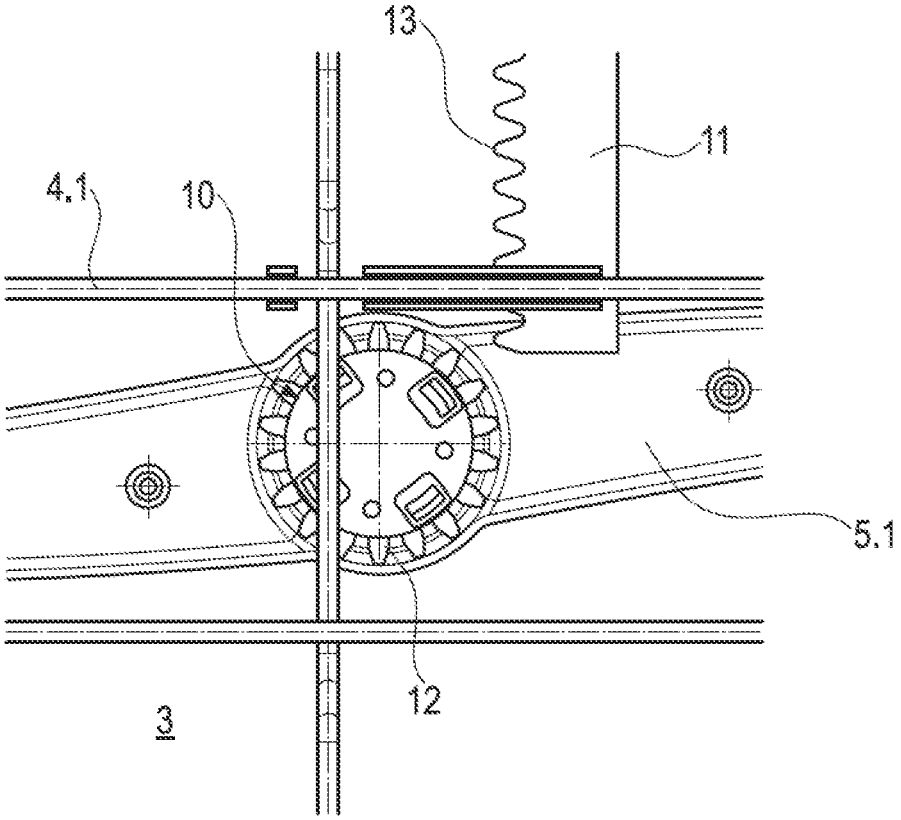
FIG. 4 shows a detailed view of the checking mechanism shown in the FIG. 3, according to a first embodiment of the present invention.
Figure 5:
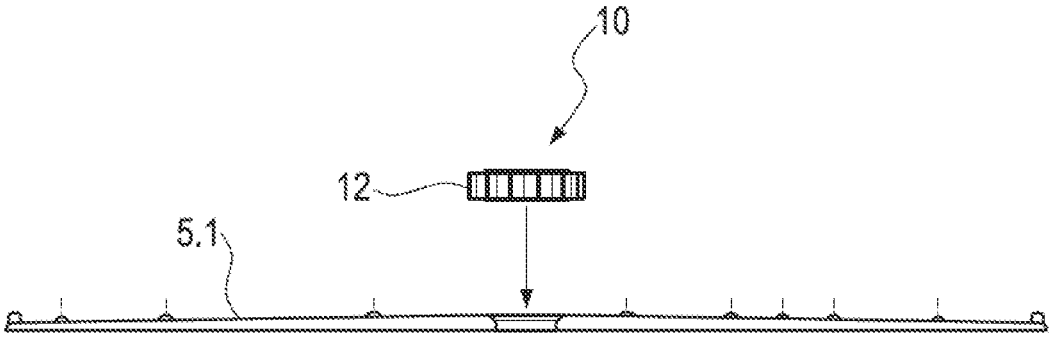
FIG. 5 shows a spray arm and a gear, according to a first embodiment of the present invention.
Figure 6:
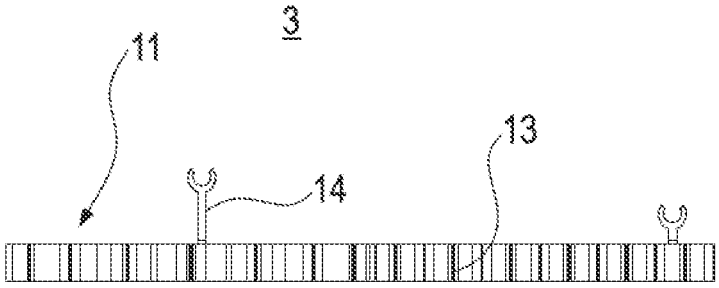
FIG. 6 shows a gear rack and connection means of the gear rack, according to a first embodiment of the present invention.
Figure 7:
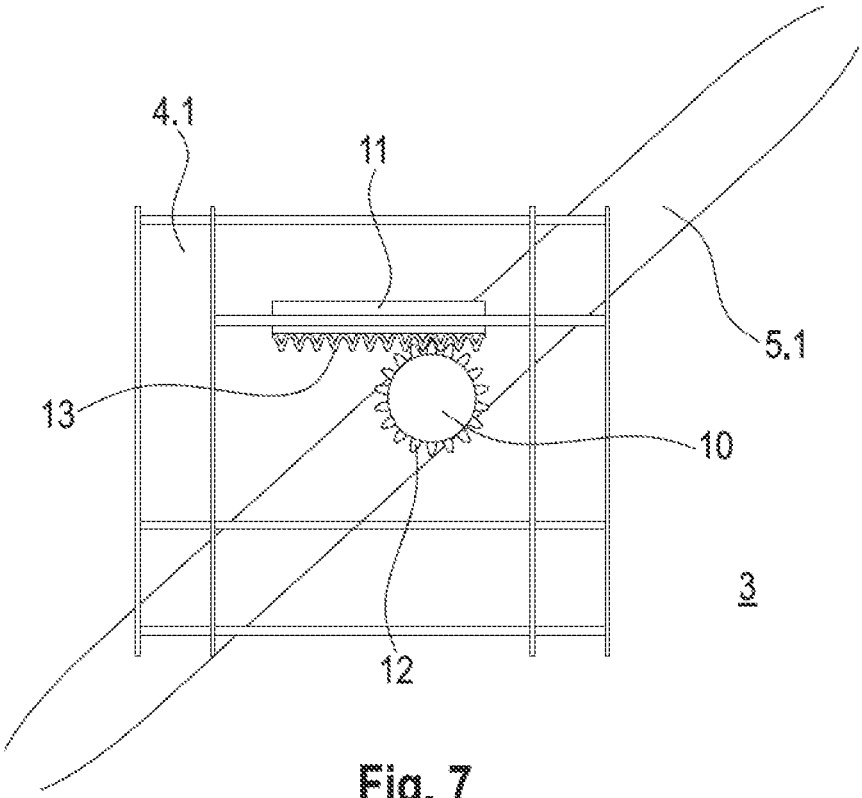
FIG. 7 shows a schematic view of the lower rack and the checking mechanism, according to a first embodiment of the present invention.

As shown in the FIGS. 4, 6 and 7, the gear 10 has gear teeth 12 and the gear rack 11 has gear teeth 13 which engage by the sliding movement of the lower rack 4.1 into the washing chamber 3. By the engagement of the gear teeth 12 of the gear 10 and the gear rack teeth 13 of the gear rack 11, the lower spray arm 5.1 starts to turn. After the lower rack 4.1 has completed the sliding movement into the washing chamber 3 to the washing position, the engagement between the gear 10 and the gear rack 11 is finalized. During the washing process, the gear 10 and the gear rack 11 do not touch each other or engage to one another.

FIG. 6 shows that the gear rack 11 is linear. The gear rack 11 has gear rack teeth 13 and is hung to the wires 8 of the lower rack (not shown; see FIG. 3), preferably by means of clipping 14.

FIG. 7 shows the gear 10 and the gear rack 11 in an engaged position. The gear teeth 12 of the gear 10 and the gear track teeth 13 of the gear rack 11 engage to each other during the sliding movement of the lower rack 4.1. This move turns the gear 10 and therefore the lower spray arm 5.1. After the lower rack 4.1 is fully slid into its place, the gear 10 and the gear rack 11 do not have any contact.

During the washing process, the gear 10 and the gear rack 11 do no longer engage. The lower spray arm 5.1 moves freely during the washing process.

Figure 8:
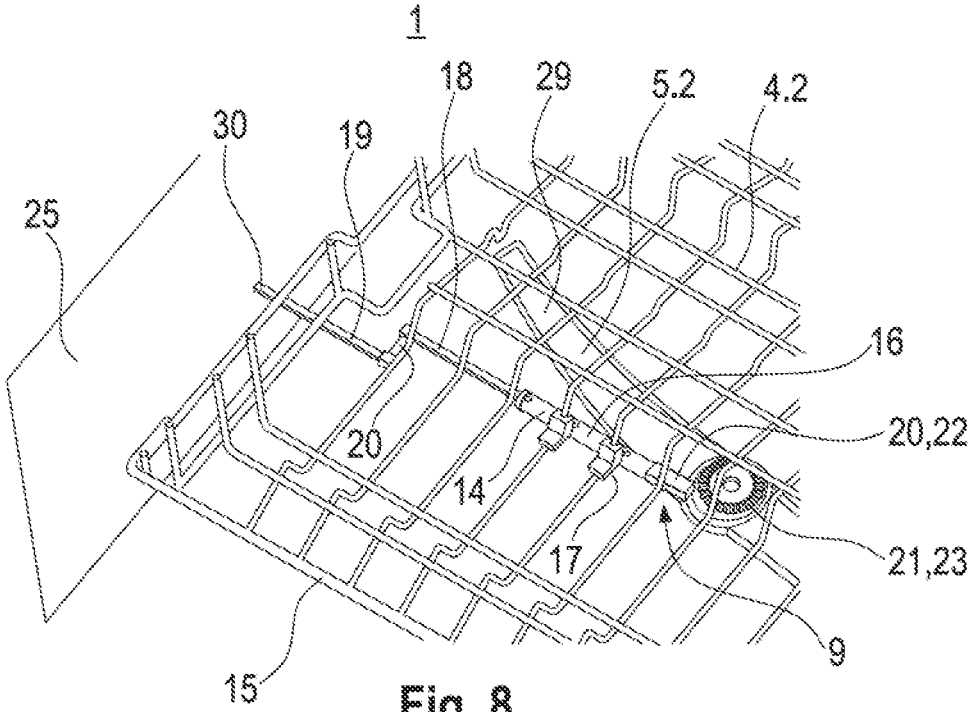
FIG. 8 shows an overview of the loading position of the upper rack according to present invention.

FIG. 8 shows the dishwasher 1 in its loading position. The upper rack 4.2 which is constituted by multiple wires 15 crossing each other, is pushed out of the dishwasher 1. The upper rack 4.2 has a checking mechanism 9. A holder 16 (see also FIG. 9) is hung on the wire 15 of the upper rack 4.2, preferably by means of clipping 14 by at least one support element 17 (see also FIG. 9). The holder 16 can easily be removed by the user if wanted. The holder 16 comprises a first rod 18 and a second rod 19. The rods 18, 19 are connected to each other by a joint 20 (see also FIG. 9). One end of the first rod 18 comprises a linear gear 22 which engages to a gear 21 on the upper spray arm 5.2. The linear gear 22 comprises linear gear teeth 24 which engage to the gear teeth 23 of the gear 21. During loading position of the upper rack 4.2, the end 30 of the second rod 19 does not touch to the back wall 25 of the dishwasher 1.

Figure 9:
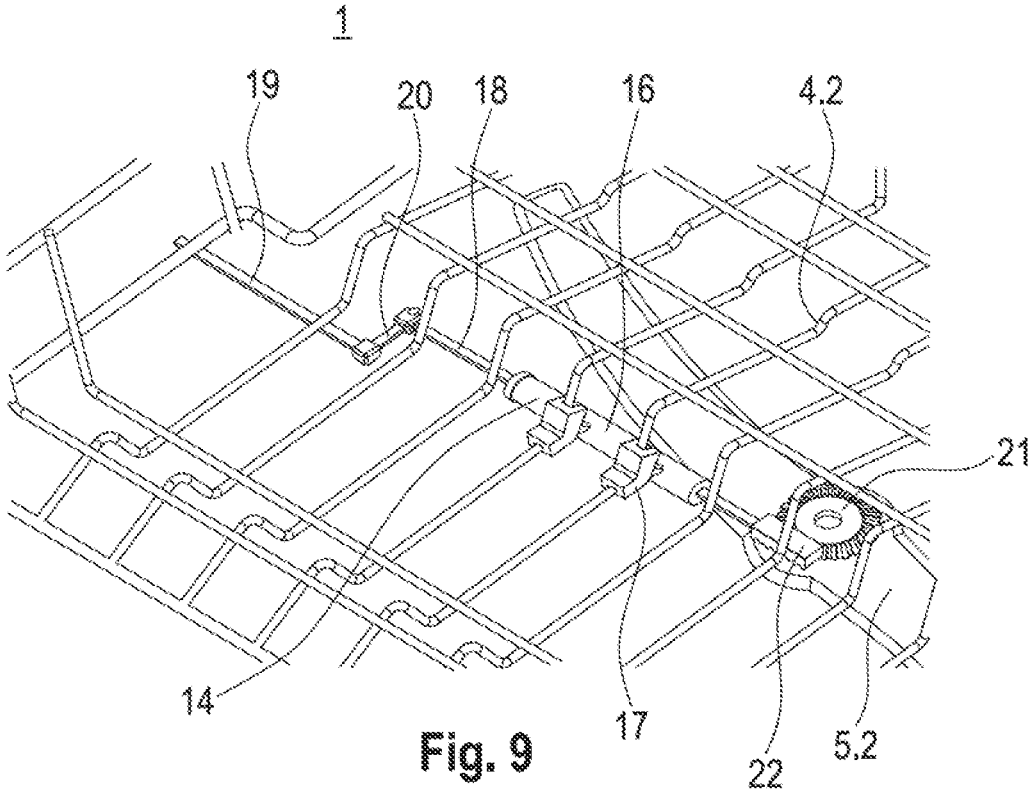
FIG. 9 shows an overview of pushed in position of the upper rack according to present invention.

FIG. 9 shows the upper rack 4.2 sliding into the dishwasher 1. With the sliding movement, the second rod 19 touches to the back wall 25 of the dishwasher 1 (see FIG. 8). As the user further slides the upper rack 4.2 into the dishwasher 1, the second rod 19 pushes the first rod 18 further into the direction towards the upper spray arm 5.2. By this pushing motion, the linear gear 22 and the gear 21 on the upper spray arm 5.2 are engaged. The force of this engagement turns the gear 21 and therefore the gear 21 turns the upper spray arm 5.2. The user checks if the free movement of the upper spray arm 5.2 is provided by checking the change of color on the either end 29 of the upper spray arm 5.2 (see FIG. 8).

Figure 10:
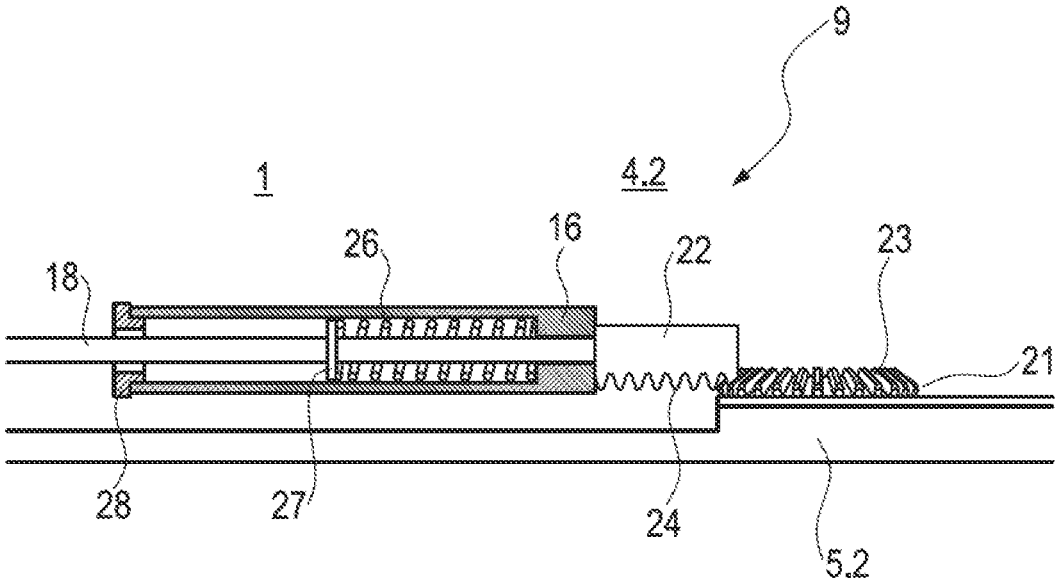
FIG. 10 shows a side view of the checking mechanism in a neutral position according to the present invention.

FIG. 10 shows the neural positon of the checking mechanism 9 as the spring 26 is not compressed when there is no sliding movement of the upper rack 4.2 into the dishwasher 1. In this position, the upper rack 4.2 is out of the dishwasher 1. The linear gear teeth 24 of the linear gear 22 and the gear teeth 23 of the gear 21 do not engage, as there is no force received from the first rod 18. The first rod 18 stays still inside the holder 16. A touching part 27 stabilizes the first rod 18. A touching part 27 also prevents the first rod 18 to move forward towards the opposite direction of the back wall 25 (see FIG. 8) so much so that the first rod 18 does not dislocate. On one end, which is in the opposite direction from the upper spray arm 5.2, the holder 16 comprises a protrusion 28 which engage to the touching part 27 to provide stabilization and balance for the first rod 18.

Figure 11:
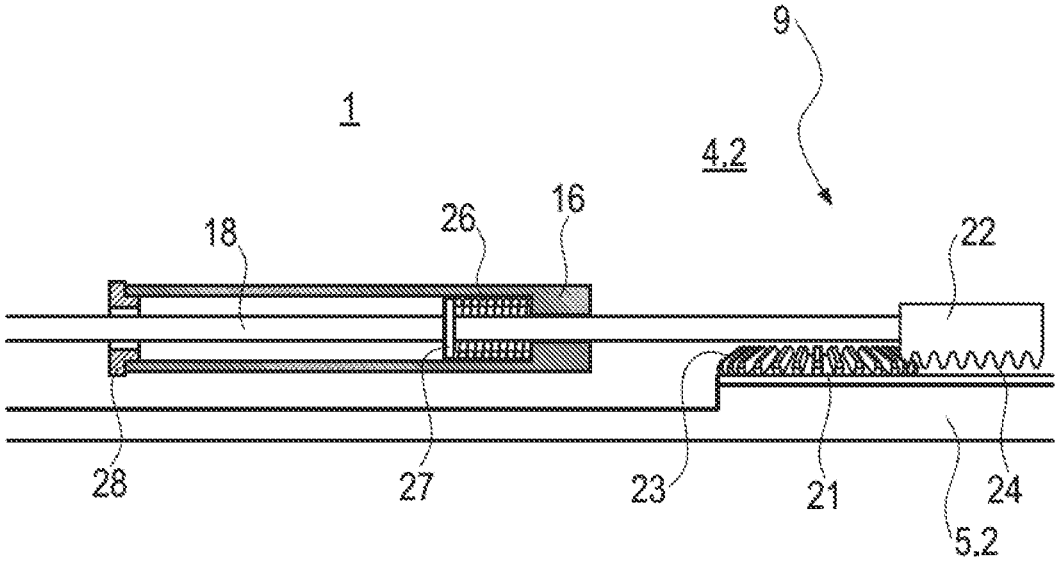
FIG. 11 shows a side view of the checking mechanism in an engaged position according to the present invention.

FIG. 11 shows the engaged position of the checking mechanism 9. As the user starts to push the upper rack 4.2 into the dishwasher 1, the second rod 19 touches the back wall 25 of the dishwasher 1. The second rod 19 which is connected to the first rod 18 by a joint 20 pushes the first rod 18 towards the opposite direction of the back wall 25. The spring 26 inside the holder 16 is compressed by the pushing force. The linear gear 22 on one end 30 of the first rod 18 is also moves to be in contact with the gear 21 which is located on the upper spray arm 5.2. The linear gear teeth 24 and the gear teeth 23 engage. By this engagement and the force on the gear 21, the upper spray arm 5.2 starts to turn. The upper spray arm 5.2 turns around itself. After the upper rack 4.2 is completely slid into its place in the dishwasher 1, the gear 21 and the linear gear 22 do not have any contact. The washing process runs without any blockages and interruptions.

Figure 12:
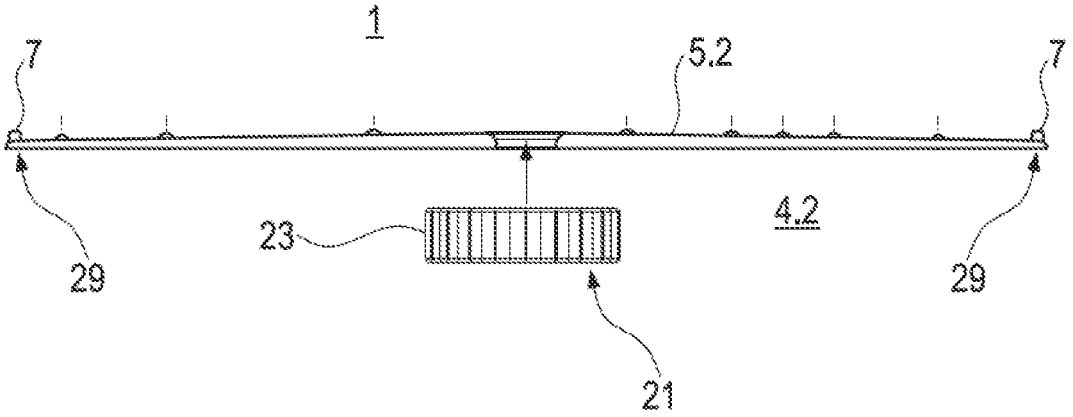
FIG. 12 shows a view of the upper spray arm and the gear according to the present invention.

FIG. 12 shows the spray arm 5.2 and the gear 21. The upper spray arm 5.2 and the gear 21 are preferably manufactured in one piece (arrow). The upper spray arm 5.2 is mounted to the upper rack 4.2. The gear 21 is attached to the substantial center of the upper spray arm 5.2. The gear 21 comprises gear teeth 23 which engage to the linear gear teeth 24 during the pushing movement of the upper rack 4.2 into the dishwasher 1 (see FIGS. 10 and 11). The gear 21 receives force to turn the upper spray arm 5.2. By this movement, the ends 29 of the upper spray arm 5.2 also turn and change position. The position change of the indicating element 7 or the color on either end 29 of the upper spray arm 5.2 informs the user of that there are no blockages for the upper spray arm 5.2 to turn freely. If there are blockages, the user can simply rearrange the dishes and/or cutlery.

The invention claimed is:

1. A dishwasher, comprising:

a body;

a washing chamber provided in the body;

a rack located in the washing chamber for loading dishes to be washed in the washing chamber;

a spray arm which rotates around itself and provides water into the washing chamber for washing the dishes; and a checking mechanism configured to translate a sliding movement of the rack into rotation of the spray arm, wherein the checking mechanism comprises a gear and a gear rack or linear gear for engagement with the gear.

2. The dishwasher of claim 1, constructed in the form of a domestic dishwasher.

3. The dishwasher of claim 1, wherein the rack is a lower rack, said gear rack being located on the lower rack.

4. The dishwasher of claim 1, wherein the spray arm is a lower spray arm, said gear being located on the lower spray arm and/or wherein the gear and the lower spray arm are manufactured in one piece.

5. The dishwasher of claim 1, wherein the gear and the gear rack are positioned in such a way as to be detached during a washing process.

6. The dishwasher of claim 1, wherein the rack is an upper rack, said gear rack being located on the upper rack.

7. The dishwasher of claim 6, wherein the spray arm is an upper spray arm directly mounted to the upper rack.

8. The dishwasher of claim 7, wherein the upper spray arm is clipped to the upper rack.

9. The dishwasher of claim 7, wherein the upper spray arm comprises a gear positioned in substantial center of the upper spray arm.

10. The dishwasher of claim 7, wherein the upper spray arm and the gear rack are manufactured in one piece.

11. The dishwasher of claim 1, wherein the rack is an upper rack, said checking mechanism comprising a holder which is attached to the upper rack by a support element.

12. The dishwasher of claim 11, wherein the holder comprises a first rod and a second rod, with the first rod being moved by a movement of the second rod.

13. The dishwasher of claim 12, wherein the first rod comprises a linear gear on an end thereof and/or wherein the holder comprises a spring configured to move the first rod.

14. The dishwasher of claim 12, wherein the second rod connects to the first rod by a joint.

15. The dishwasher of claim 11, wherein the holder is clipped to the upper rack.

16. The dishwasher of claim 1, further comprising an indicating element provided on one end of the spray arm.

17. The dishwasher of claim 16, wherein the indicating element is snap-fitted to the one end of the spray arm.

18. The dishwasher of claim 16, wherein the indicating element and the spray arm are manufactured in one piece.

19. The dishwasher of claim 16, wherein the indicating element is adhered to the one end of the spray arm.

* * * * *